US006318607B1

(12) United States Patent
Koskela

(10) Patent No.: US 6,318,607 B1
(45) Date of Patent: Nov. 20, 2001

(54) SHOE HORN

(76) Inventor: Vesa Koskela, Torsten Alms Gata 22, 126 51 Hägersten (SE)

( * ) Notice: Subject to any disclaimer, the term of this patent is extended or adjusted under 35 U.S.C. 154(b) by 0 days.

(21) Appl. No.: 09/454,055

(22) Filed: Dec. 2, 1999

Related U.S. Application Data

(63) Continuation of application No. PCT/SE98/01133, filed on Jun. 12, 1998.

(30) Foreign Application Priority Data

Jun. 13, 1997 (SE) ..... 9702274

(51) Int. Cl.[7] ..... A41B 1/18
(52) U.S. Cl. ..... 223/118
(58) Field of Search ..... 223/118, 119, 223/84, 111

(56) References Cited

U.S. PATENT DOCUMENTS

| | | | | |
|---|---|---|---|---|
| 803,135 | * | 10/1905 | Rorback | 223/118 |
| 990,283 | * | 4/1911 | Merrow | 223/118 |
| 1,403,338 | * | 1/1922 | Minkoff | 223/84 |
| 1,690,516 | * | 11/1928 | Wickers | 223/118 |
| 1,832,339 | * | 11/1931 | Wilke | 223/84 |
| 2,133,068 | * | 10/1938 | Wiegman | 223/84 |
| 2,171,310 | * | 8/1939 | Morgan | 223/118 |
| 3,107,830 | * | 10/1963 | Teague | 223/84 |
| 3,175,307 | * | 3/1965 | Evans | 223/118 |
| 4,007,928 | * | 2/1977 | Doubt | 223/118 |
| 4,290,539 | * | 9/1981 | Lowery | 223/118 |
| 5,741,569 | * | 4/1998 | Votino et al. | 223/118 |

* cited by examiner

*Primary Examiner*—Bibhu Mohanty
(74) *Attorney, Agent, or Firm*—Jeffrey Slusher

(57) ABSTRACT

A shoe horn (1) of a flexible, thin material such as plastic or metal that, in use, changes its shape to approximately correspond to the rear or inner portion of a shoe where the heel of the user is to be inserted. Its size does not significantly exceed the standard size of a bank (ATM) or credit card, so that it can be stored, for example, in a wallet. The shoe horn can comprise two or more portions (1*a*, 1*b*) of different shapes having shoulders or hook-shaped portions (1*c*) that prevent the shoe horn, in use, from gliding down into the shoe.

1 Claim, 2 Drawing Sheets

SHOE HORN

CROSS-REFERENCE TO RELATED APPLICATIONS

This application is a continuation of the pending International Patent Application No. PCT/SE98/01133, filed Jun. 12, 1998.

FIELD OF THE INVENTION

The present invention relates to a shoe horn of a flexible, thin material, for example, plastic or metal, which, in use, changes its shape to correspond approximately to the inner rear portion of a shoe where the heel of the user is inserted.

STATE OF THE ART

Shoe horns of the conventional type, that is, that are made of a hard material and are C-shaped, are bulky to carry.

U.S. Pat No. 2,171,310 (Morgan) describes a flexible, flat shoe horn with the ability to adjust its shape. It consists of a casing of leather with an enclosed packet of threads or feathers that can be pulled out when the shoe horn is to be used. Even this shoe horn is relatively clumsy and thick and cannot easily be stored in, for example, a wallet.

The same is true for the shoe horn that is described in DE, A, 341,089 (Harper).

U.S. Design Pat. Nos. 355,522 and 360,743 (both in the name of Simpson) have handle portions that extend from a flat surface and that make storing them difficult.

The Swiss patent text 183,654 (Urban-Klump) describes a shoe horn of a thin, flexible material that allows it to adjust it to a heel that is to be inserted into a shoe. The shoe horn has an outer, approximately oval handle portion; a lower portion of the shoe horn has such a length that the handle portion, when the shoe horn is being used, is located a considerable distance above the heel of the shoe in which the shoe horn is to be used. The length of the shoe horn is such that it cannot be stored in, for example, a wallet.

SE, A, 9,202,512 (Furendal) describes a shoe horn for disabled persons, whose main idea is that, by using a "clip," one can anchor the shoe horn in place on the shoe before an attempt is made to put it on. A clip of this type has elements that extend from the plane of the shoe horn; this not only makes it more difficult to insert the foot into the shoe, but also makes the shoe horn less suitable for storing in, for example, a wallet.

U.S. Pat No. 865,462 (Weeks) describes a shoe horn that has the disadvantage that it cannot assume a definite position relative to the shoe when the foot is inserted, so that one must as a rule hold the shoe horn when the foot is inserted into the shoe, which complicates the procedure.

OBJECTS OF THE INVENTION

The object of the invention is to provide a shoe horn that, more securely than known shoe horns, cooperates with the shoe when the shoe is being pulled on so that this is made easier and also so that one can easily carry it without it being too bulky.

The shoulders or hook-shaped portions between the portions of the shoe horn contribute to fixing the shoe horn in position on the shoe in connection with the procedure of putting the shoe on, which means that this can be done essentially without having to hold the shoe horn, whereby the procedure of putting the shoe on is made easier and, if desired, can be done while standing.

At least one side can be coated or treated in order to reduce friction so that it is easier to insert the foot.

Because of the shape of the shoe horn, it can with advantage have print, for example, an advertising message.

Some embodiments of the shoe horn according to the invention are shown in the accompanying drawings.

DESCRIPTION OF PREFERRED EMBODIMENTS

Figure 1:
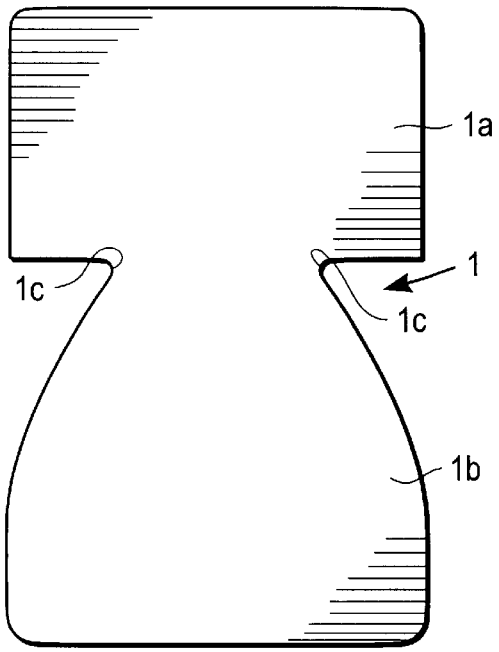
FIGS. 1–3 are plan views of four shoe horns according to the invention made with different shapes.
Figure 2:
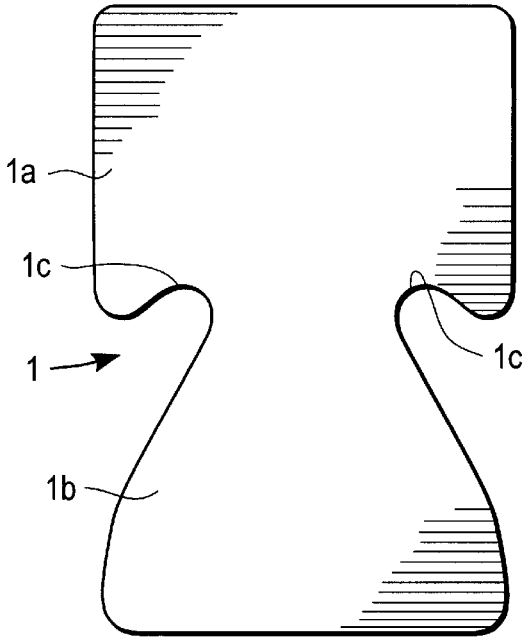
Figure 3:
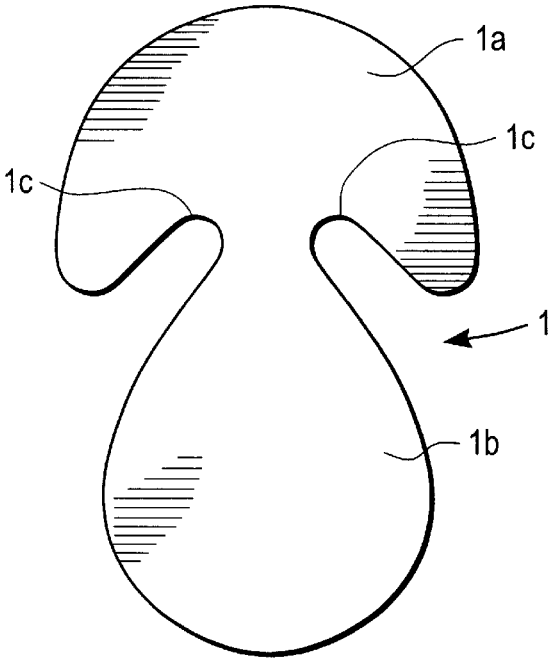
Figure 4:
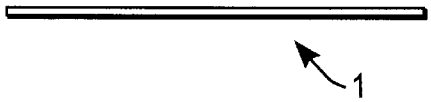
FIG. 4 is a front view of a shoe horn according to any of the preceding figures illustrating that it is made of a thin material.

FIGS. 1–3 show examples of shoe horns 1 made of a thin flexible material, for example, plastic or metal, formed in different ways. In use, the shoe horns will thereby change their shape to approximately correspond to the rear portion of a shoe when the heel of a user is inserted.

As can be seen from the illustrated embodiments, the general shape of the shoe horns can vary within wide margins. In common it to all, however, is that they have no portions or parts that extend out from the plane of the two parallel side surfaces; moreover, the size does not significantly exceed the size of a bank (ATM) or credit card. Simple storage of the shoe horn in, for example, a wallet, is thereby made possible.

As is shown in FIGS. 1–3, the shoe horn has two or more portions of different widths and/or shapes 1*a*, 1*b*. At the transition between these portions are shoulders or hook-shaped, cut-out portions 1*c* that prevent the shoe horn from gliding down into the shoe when in use. The length of the portion 1*b* should preferably correspond to or be somewhat less than the height of the heel of a shoe in which the shoe horn is to be used. Starting up with a "standard size" for the shoe horn, it is also possible to give the portion 1*b* the desired shape and length using a pair of scissors.

At least one side of the shoe horn can be coated or treated in order to reduce friction so that it will be easier to insert the foot.

One or both of the sides can also be provided with print (not shown), for example, an advertising message.

Figure 5:
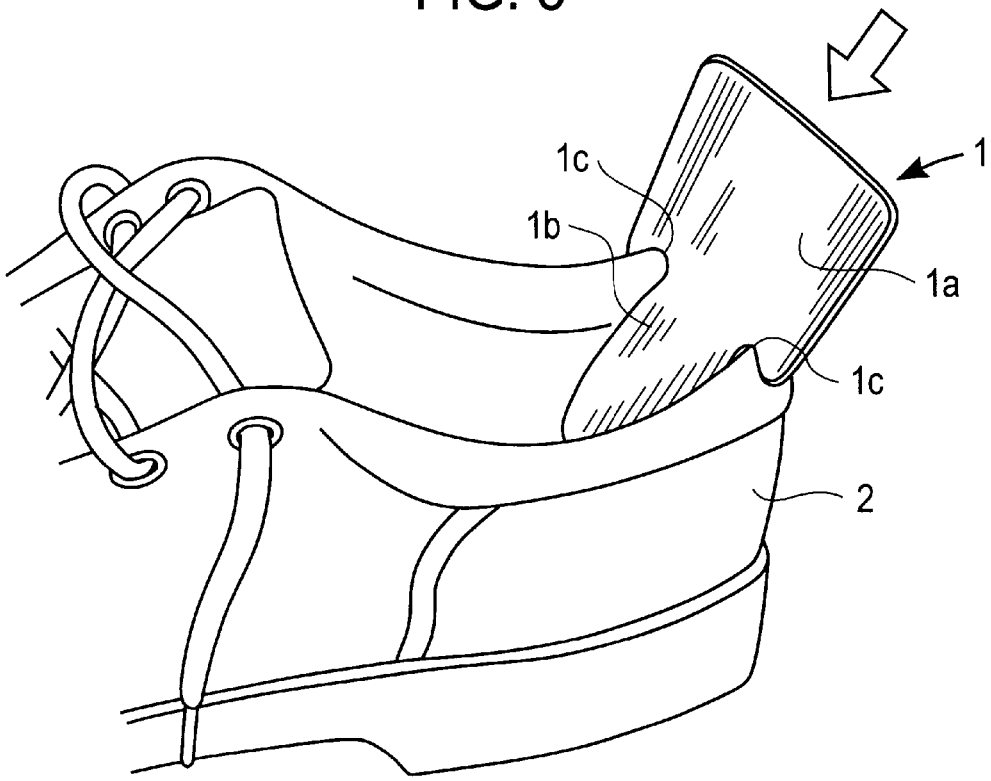
FIG. 5 is a perspective view of a portion of a shoe with a shoe horn according to the invention inserted.
Figure 6:
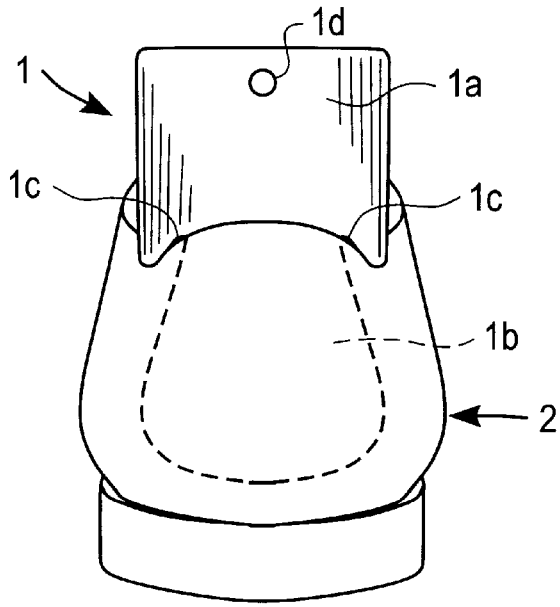
FIG. 6 is a view from the rear of a shoe with an inserted shoe horn.

FIGS. 5 and 6 illustrate how the shoe horn 1, which, in the unused state is completely flat, will bend and shape itself to the contour of the foot when in use in contact with a foot that presses against the rear or heel of the shoe. The foot will then glide against the shoe horn down into the shoe without catching against the heel.

When the foot is inserted into the shoe, the shoe horn is easily drawn out by pulling on the large, easy-to-grip surface that is located above the heel cap. The shoe horn may also be provided with a hole 1*d* for a string (not shown) that can make it easier to remove the shoe horn for a person who has difficulties bending.

What is claimed is:

1. A shoe horn comprising:

main surfaces that, in an unused state, are flat;

an upper portion;

a lower portion; and shoulder portions located between the upper and lower portion and formed of inward-extending cut-outs in either of two opposing, otherwise parallel side edges of the main surfaces;

in which:

the shoe horn is substantially rectangular, with an upper edge and a lower edge of approximately equal length and shorter than the side edges;

in a used position, the lower portion extends within a shoe, the upper portion extends above an upper edge of a heel of the shoe; the shoulder portions extend outward and substantially laterally over an edge of the heel of the shoe, the shoulder portions forming means for preventing the shoe horn from gliding further into the shoe when a user inserts a foot into the shoe; and the shoe horn is made of a thin, flexible material, the shoe horn bending and conforming substantially to the shape of the user's heel when the user inserts a foot into the shoe and returning to being flat when removed from the shoe; and the size of the shoe horn corresponds substantially to the size of a standard credit card.

* * * * *